United States Patent [19]

Steiner et al.

[11] Patent Number: 4,890,549

[45] Date of Patent: Jan. 2, 1990

[54] FOOD HANDLING DEVICE

[76] Inventors: Gregory Steiner, 5107 Indiana Ave., Lisle, Ill. 60532; Hari Matsuda, 3915 Howard St., Skokie, Ill. 60076

[21] Appl. No.: 235,424

[22] Filed: Aug. 24, 1988

[51] Int. Cl.[4] ..... A47J 43/28

[52] U.S. Cl. ..... 99/450; 30/136; 24/555; 24/545; 24/487; 24/570; 24/571; 24/530; 24/563

[58] Field of Search ..... 99/449, 450; 30/136, 30/143, 144, 153, 162, 333, 334, 335; 24/460, 570, 571, 487, 530, 545, 555, 563

[56] References Cited

U.S. PATENT DOCUMENTS

| | | | |
|---|---|---|---|
| 400,537 | 4/1889 | Barry | 30/136 |
| 738,318 | 9/1903 | Grabler | 24/563 |
| 836,440 | 11/1906 | Collins | 30/136 |
| 1,332,442 | 3/1920 | Kane | 24/460 |
| 1,538,808 | 5/1925 | Hedeen | 30/136 X |
| 4,226,006 | 10/1980 | Toyama | 24/545 |
| 4,569,130 | 2/1986 | Koller et al. | 30/136 X |

FOREIGN PATENT DOCUMENTS

| | | | |
|---|---|---|---|
| 141332 | 4/1935 | Austria | 30/136 |
| 391311 | 10/1908 | France | 24/555 |
| 1277149 | 10/1961 | France | 24/487 |
| 10943 | of 1896 | United Kingdom | 24/545 |

*Primary Examiner*—Jimmy G. Foster
*Assistant Examiner*—Christine A. Peterson
*Attorney, Agent, or Firm*—Basil E. Demeur; Alan B. Samlan; Robert E. Knechtel

[57] ABSTRACT

There is disclosed a food handling device especially adapted for handling sliced food products, such as pizza pies or the like, which consists of a base support means forming a food support surface, food gripping means positioned above and substantially parallel to the base support means, and flexible means interconnecting the food gripping means with the base support means. The flexible means is formed of a relatively resilient material in order to permit the food gripping means to be reciprocable toward the base support means. In the preferred embodiment, the base support means, food gripping means and flexible means are integrally formed thereby to provide a food handling device which is unitary in construction. An alternative embodiment further includes a food support member which is slidably engageable with a pair of rail means provided on the lower surface of the base support means which is slidably adapted to alternately expand and decrease the overall food support surface of the food support base in relation to the size of the food product slice supported thereon.

16 Claims, 2 Drawing Sheets

FOOD HANDLING DEVICE

BACKGROUND OF THE INVENTION

The art field with respect to providing handling devices for food products has, in the recent past, become more intense in that it has been found desirable to provide means for handling food product without having direct contact between the user and the food product to be consumed. This is especially prevalent with respect to prepared food products which are handled by the ultimate consumer, or by personnel intermediate between the food preparation location, and the ultimate consumer.

It is well known with respect to liquids, that a wide variety of devices are available for containing a liquid to be consumed, and for permitting the user to consume the liquid directly from the container without any intermediate handling of the liquid. Various other devices have been provided by the art field for handling solid food products, and this is especially true with respect to food products sold in bulk form from containers. For example, various types of bins have been created thereby to provide the consumer with a means to grasp food product from a container in which a bulk source of the food product is available, and to insert the same into an individualized container without at the same time handling the food product. The purpose of such containers is to ensure sterility and integrity of the food product as between the various consumers having access to the container.

However, with respect to prepared food products, and especially some food products such as pizza pies, and other types of pies and cakes, other than the standard typical manner of handling such food products such as a plate and fork, very few handling devices have been developed. As to the food handling devices which have been developed to date, it has been difficult to provide such a device which may be sold with or accompany the package in which the food product slice to be used by the ultimate consumer. Such a device would avoid any handling of the food product by intermediate personnal prior to delivery to the consumer. Exemplary of this situation is the pizza pie industry wherein the explosion of pizza restaurants and home delivery pizza establishments has created a significant economic market in such food products. Typically, pizza pies intended for home delivery are prepared by the retail location, and boxed by the employees of the retail location for delivery to the consumer. Ultimately, such product is delivered to the consuemr in a box type container and the consumer must then handle the food product directly in order to consume the same.

The present invention also permits use in actual restaurant facilities and may be employed for the purpose of consuming any prepared food product when vended by the slice to avoid the necessity for utilizing cumbersome knife and fork arrangements for eating such food product. The food handling device of the present invention may be provided to the restaurant patron in a disposable format so that after use, it may be simply discarded thereby to provide not only an efficient manner for eating sliced food products, but also a sanitary method of doing so.

The present invention is intended to provide an improved food handling device which may be packaged with the food product, and tendered to the consumer for use by the consumer in handling individual slices of the food product while avoiding direct contact with the food product per se.

OBJECTS AND ADVANTAGES

It is therefore the principal object of the present invention to provide a food handling device, especially adapted for individualized food product slices such as pizza pies, or other sliced food products, which permits ease of manipulation, while at the same time avoiding direct contact between the consumer, and the individualized food product slice to be handled thereby.

In conjunction with the foregoing object, it is a further object of the present invention to provide a food handling device of the type which is formed by a base support means which forms a food support surface, food gripping means positioned in its use position above and substantially parallel to the base support means, and flexible means interconnecting the food gripping means with the base support means, the flexible means being relatively resilient such that the food gripping means may be reciprocated toward or away from the base support means to arrest and grip an individualized food product slice therebetween to afford the user the opportunity to handle the food product slice without direct contact with the food product.

In conjunction with the foregoing objects, it is a further object of the present invention to provide a food handling device of the type described wherein the base support surface, gripping flange and flexible members are formed integrally and are unitary in construction.

In conjunction with the foregoing object, it is a further object of the present invention to provide a food handling device of the type described, wherein the base support surface, gripping flange and flexible means assume an initial rest position wherein the elements are planar with respect to one another, with the gripping flange being movable into a use position substantially above and overlying the base support surface via resilient flexible means thereby to permit the gripping flange to be positioned above the base support surface in order to arrest a food product slice therebetween to facilitate the manipulation of the food product without direct contact therewith.

A further object of the present invention is to provide a food handling device of the type described, wherein the base support surface may further be provided with a pair of rail means along the lower surface thereof, and a food support member is provided, slidably engageable within the confines of the rails formed under the base support surface such that the food support member is adapted to alternatively expand and decrease the overall food support surface in relation to the size of the food product slice supported thereon.

In conjunction with the foregoing objects, a further object of the present invention is to provide a food handling device of the type described, wherein the base support surface, is further provided with a plurality of cutting serrations formed along the length thereof, thereby to provide a cutting edge integrally formed with the food handling device for cutting the food product preliminary to handling the same.

Further features of the invention pertain to the particular arrangement of the parts whereby the above-outlined and additional operating features thereof are attained.

The invention, both as to its organization and method of operation, together with further objects and advantages thereof, will best be understood by reference to the following specification taken in conjunction with the accompanying drawings.

SUMMARY OF THE INVENTION

In summary, the present invention provides an improved food handling device which is particularly adapted for handling individualized food product slices of the type generally represented by pizza pie, other types of pies, cake slices, and other sliced food products, wherein the device may be utilized by the consumer to arrest an individualized food product slice, and to manipulate the same without direct food contact. The food handling device of the present invention is formed by a base support surface which may be inserted under the food product slice to be manipulated, and having a food gripping element positionable, when in use, into a position above and overlying the base support surface, the food gripping flange being interconnected with the food support surface by means of a pair of resilient flexible members, such that the food gripping flange may be reciprocated downwardly toward the base support surface thereby to grip an individualized food product slice inserted therebetween, with the base support surface and the gripping flange providing gripping surfaces for the consumer's hand to facilitate the gripping and manipulation of the food product slice therebetween.

The present invention provides alternative embodiments for a food handling device of the type described wherein in one embodiment, the entire device may assume an initial rest position wherein all elements forming the food handling device are in a planar orientation but may be moved into a use position with the food gripping flange overlying the base support surface. This particular embodiment permits ease of packaging such that a device of the type described may be packaged with the food product when delivered to the ultimate consumer and provide the ultimate consumer with the food handling device while at the same time, avoiding expensive and cumbersome packaging difficulties.

DETAILED DESCRIPTION OF DRAWINGS

Figure 1:
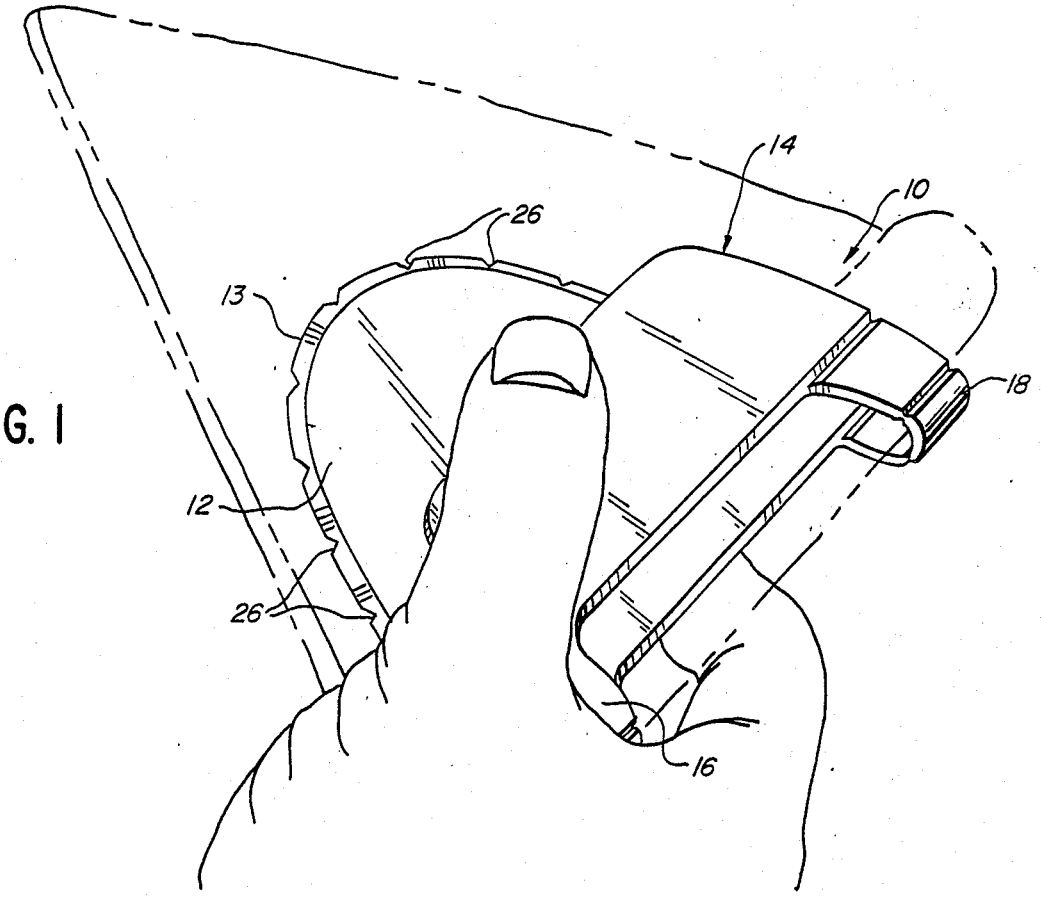
FIG. 1 is a perspective view showing one embodiment of the food handling device of the present invention when in use in connection with the gripping and manipulation of an individualized food product slice contained with the device.
Figure 2:
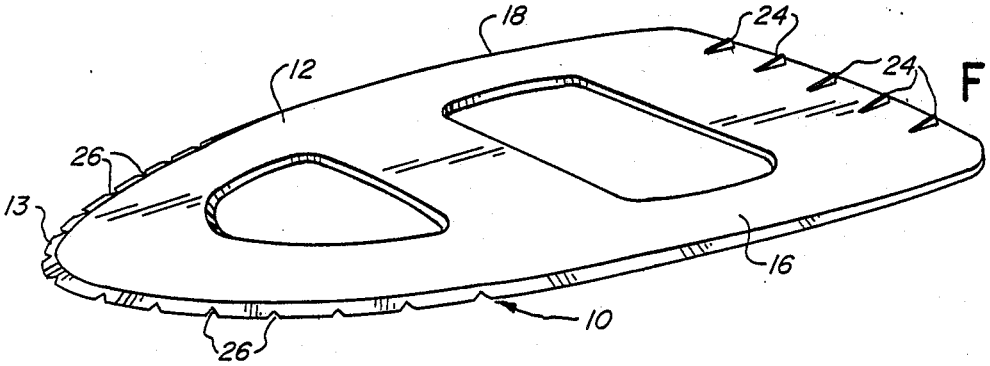
FIG. 2 is a perspective view showing the food handling device in its rest position wherein all of the elements forming the same are in a planer orientation.
Figure 3:
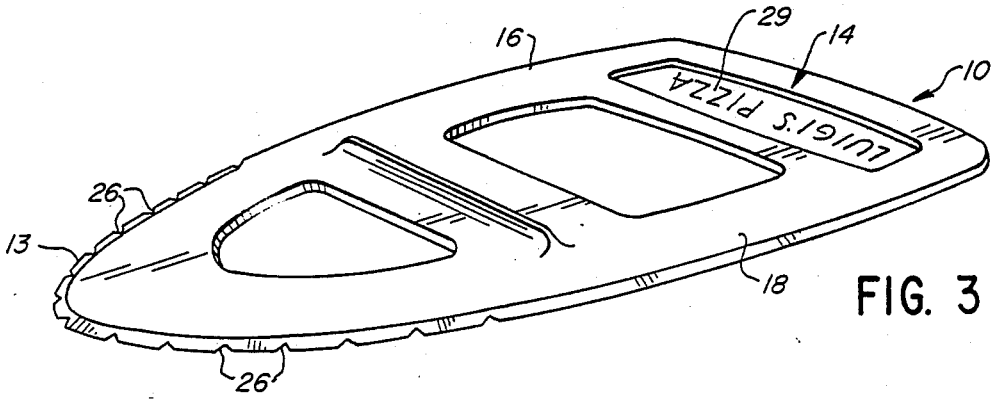
FIG. 3 is a perspective view showing the outer surface of the food handling device of FIG. 2, once again, with all elements being in their planer rest orientation.

With respect to the embodiment of the invention showing FIGS. 1 through 3 of the drawings, it will be apparent that the food handling device 10 of the present invention is particularly adapted for handling and manipulating an individualized food product slice, and typically would consist of a food product such as pizza pie, fruit flavored pies, cake slices and the like. It will be appreciated, however, that the food handling device 10 of the present invention is adapted to handle and manipulate many other types of food products, the essential requirement being that the food product being handled is essentially flat in configuration, as opposed to a spherical food product such as fruits, vegetables and the like.

With respect to FIGS. 1 through 3 of the drawings, the food handling device 10 is shown to be capable of handling an individualized food product slice such as a pizza slice 5 (figure 1). The food handling device 10 is formed by a base support 12, food gripping means 14 and a pair of flexible members 16 and 18 respectively which interconnect the food gripping means 14 with the base support 12.

As shown in FIGS. 2 and 3 of the drawings, the food handling device 10 depicted in this embodiment may assume an initial rest position wherein the base support 12, food gripping means 14, and flexible members 16 and 18 respectively, assume a planar configuration such that the entire food handling device 10 is essentially flat and may be packaged as such. FIG. 1 illustrates the use position which may be achieved by simply moving the food gripping means 14 into an overlying and parallel relationship with respect to the base support 12 via the flexible members 16 and 18 respectively. This motion is achieved by forming the flexible members 16 and 18 of a relatively resilient material, such as plastic or the like, thereby to permit the movement of the food gripping means 14 upwardly and into an overlying position relative to the base support 12.

The food gripping means 14 is generally formed by means of a food gripping flange 22, which contains a plurality of food gripping elements 24 formed along the under surface thereof as shown in FIG. 2 of the drawings. It will be appreciated from a view of FIGS. 1 and 2 of the drawings, that when the food gripping flange 22 is manipulated via the flexible members 16 and 18 into an overlying position with respect to the base support 12, the food gripping elements 24 will be facing downwardly toward the individualized food product slice which is arrested therebetween as shown in FIG. 1 of the drawings. With respect to those food products, such as pizza pie slices which have a crust along the outside edge thereof, the food gripping elements 24 serve the purpose of gripping down into the crust portion of the food product thereby to provide the consumer with a reasonably sure grip for maintaining and arresting the food product slice therebetween.

It will also be observed that the base support 12 may be provided with a plurality of serrations 26 formed along the peripheral edge 13 thereof which thereby form a cutting edge which aids the consumer in fully and finally cutting the individualized food product slice preliminary to the manipulation and handling thereof. This will be especially appreciated in connection with pizza pie products, which are usually delivered to the ultimate consumer in a semi-cooled state such that the individualized pieces, while pre-cut at the retail location, tend to coalesce and obscure the cut lines requiring a further cutting operation. For example, it is known that when cheese as a food product is hot and is cut, the cut is fairly significant, however while the cheese is hot, the cheese tends to coalesce, thereby obscuring the previously formed cut line in the food product.

FIGS. 1 and 3 further illustrate the provision of the gripping bar 28 integrally formed along the lower surface of the base support 12, which provides the consumer with a gripping surface against which the fingers of the consumer may be pressed while handling and manipulating the food product 5. The upper surface of the food gripping flange 22 may further be provided with a legend space 29, adapted to carry the name of the retail establishment for promotional purposes.

It will be appreciated from a view of FIGS. 1 through 3 of the drawings, that the food handling device 10 as depicted therein may be easily packaged with, for example, a pizza pie which is generally boxed in a flat box for shipment to the consumer, since the food handling device 10 will assume an initial rest position which is planar and flat in configuration. Hence, the food handling device 10 may either be packaged in the interior confines of the box, or may be affixed to the outer surface of the box, by enclosing the same in a substantially flat sterile paper container and affixed to the outer surface of the box. The device may be easily manipulated into its use position as shown in FIG. 1 of the drawings, in the manner heretofore indicated.

Furthermore, by configuring the food handling device 10 in a flat planer rest position, both ease and greater economics in the manufacturing process are achieved since a great many of the devices may be formed in a single flat piece of cardboard or plastic and simply die-cut therefrom. In additon, it is possible that several of these devices could be provided to the same consumer in the same package since the initial planer rest position takes up a small amount of space within the package, or along the outer confines thereof.

A further advantage derived from the food handling device 10 assuming an initial rest position which is planer and flat in configuration is that that format presents a better shipping form such that many more pieces can be shipped flat from the manufacturer to the retail user. It will be appreciated that when manufactured, it is contemplated that the food handling device 10 may be formed of either plastic or cardboard for that matter, and that several such devices may be formed in a single flat piece of the forming material and shipped to its ultimate use point. Hence, the manufacturing costs as well as the cost of transportation are minimized in creating a simple and easy format for transportation purposes.

Figure 5:
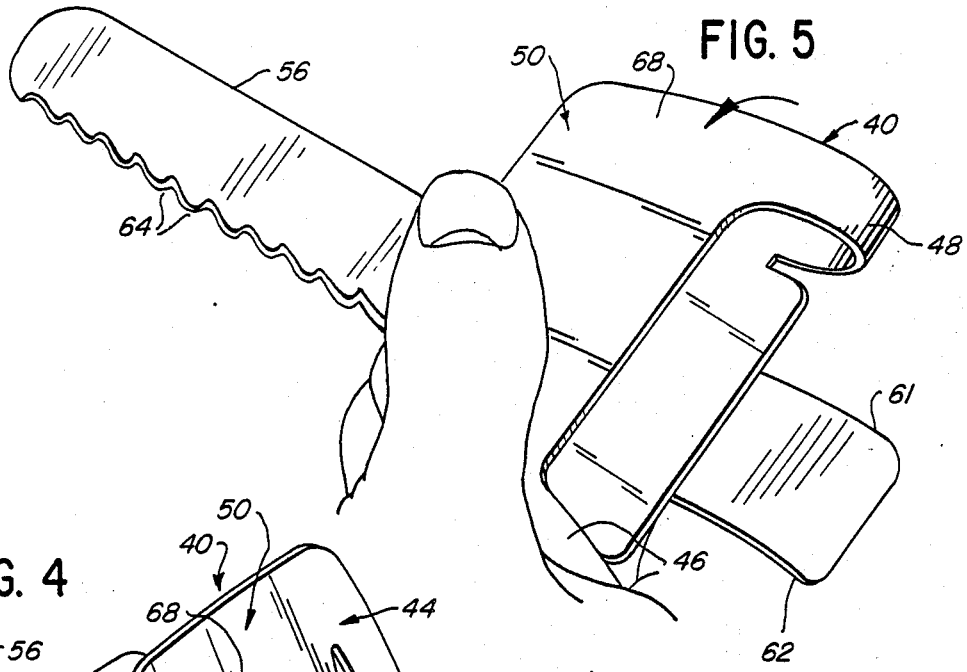
FIG. 5 is a perspective view of the food handling device of FIG. 4, showing the use position of the food handling device with the food gripping flange reciprocated in the direction of the base support surface.
Figure 4:
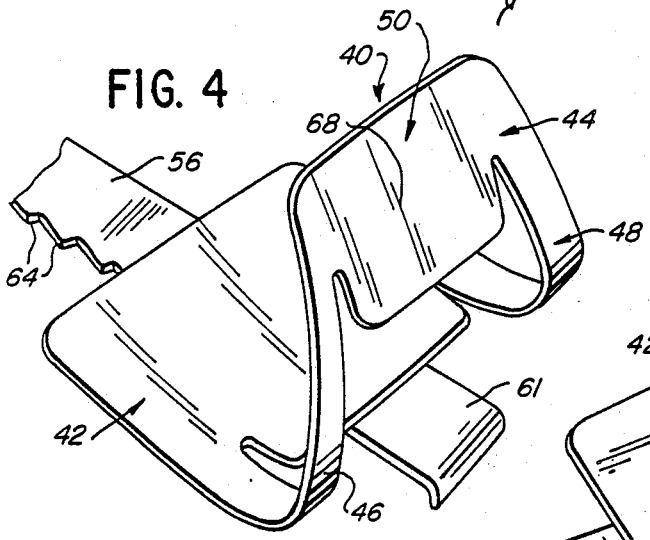
FIG. 4 is a perspective view of an alternate embodiment of the food handling device of the present invention, including a food support base, a food gripping flange substantially overlying the base, the food gripping flange and base being interconnected by a pair of opposed flexible members, and including a food support member slidably engageable by the lower surface of the food support base.

With respect to the embodiment illustrated in FIGS. 5 through 9 of the drawings, an alternate embodiment of a food handling device 40 is illustrated. In this embodiment of the invention, the food handling device 40 assumes an initial rest position as generally illustrated in FIG. 4 of the drawings. The food handling device 40 is shown to be formed by base support 42, food gripping means 44, and a pair of opposed flexible members 46 and 48 respectively, interconnecting the food gripping means 44 with the base support 42. Once again, it is contemplated that the base support 42, food gripping means 44 and flexible members 46 and 48 respectively are formed of a plasticized material, and are integrally formed thereby to provide a device 40 which is of unitary construction. On the other hand, the flexible material of which the device is formed must be sufficiently resilient in order to permit the food gripping means 44 to be reciprocably movable toward the base support 42 in order to grip and arrest an individualized food product slice therebetween as generally depicted in FIG. 5 of the drawings.

As indicated previously, FIG. 4 illustrates the initial rest position of the food handling device 40 contemplated by this embodiment of the invention. In this position, the food gripping means 44 is generally above and substantially overlying the base support 42, although the same are sized apart a distance sufficient to permit the initial insertion of an individualized food product slice therebetween before the gripping motion is initiated. As with the embodiment illustrated in FIGS. 1 through 3 of the drawings, the food gripping means 44 is shown to be formed by a food gripping flange 50, which includes an under surface 52 and contains a plurality of food gripping elements 54 formed thereon. It will be appreciated that while using the food handling device 40 in the embodiment as shown, and as depicted in FIG. 5 of the drawings, as the consumer manipulates the food gripping flange 50 downwardly toward the base support 42, the food gripping elements 54 will grip the edge or crust edge of the food product slice contained therein thereby to give the consumer a firm grasp on the food product.

Alternatively, in forming the embodiment as depicted in FIGS. 5 through 9 of the drawings, the food gripping means 44 may be molded to be positioned above and substantially overlying the base support 42, but molded in its down position. In this embodiment, in order for the consumer to utilize the device 40, the food gripping means 44 would be pulled upwardly away from the base support 42, until the food product can be inserted therein, and upon releasing of the food gripping means 44, the same will naturally be biasingly urged downwardly toward the base support 42 to grip the food product slice therebetween. It is contemplated that the device 40 may be molded in either configuration and it is intended to cover in the present application and related claims both versions of the device 40.

Figure 7:
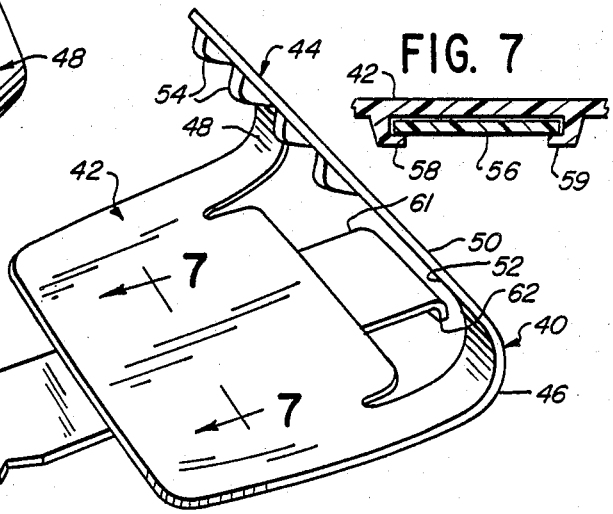
FIG. 7 is a side elevational view in cross section, showing the relationship between the base support member contained and carried by a pair of opposed rail members formed on the under surface of the base support surface thereby to render the base support element slidably engageable therein, and taken in the direction of the arrows along the line 7—7 of FIG. 6.
Figure 6:
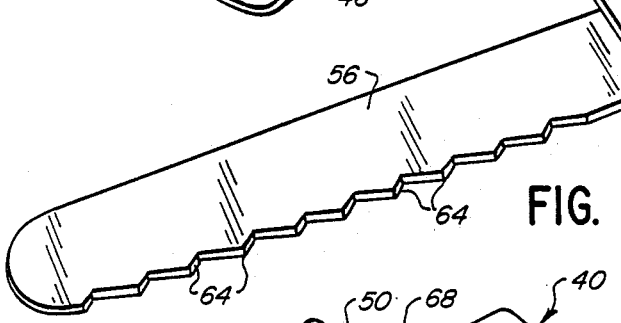
FIG. 6 is a perspective view showing the food handling device as generally depicted in FIGS. 4 and 5 of the drawings, and showing the interrelationship between the base support surface, upper food gripping flange, and the slidably engageable food support member carried on the lower surface of the base support surface.
Figure 8:
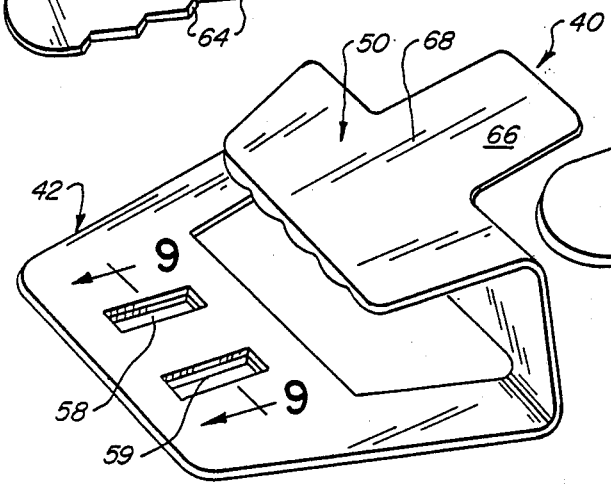
FIG. 8 is a perspective view, showing the base support member being totally withdrawn from the under surface of the base support surface, and illustrating the opposed rail members which carry the base support member therein.
Figure 8:
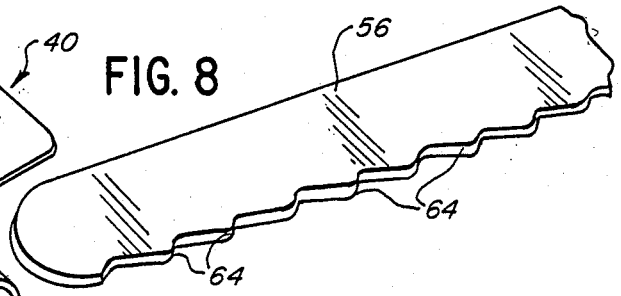
Figure 9:
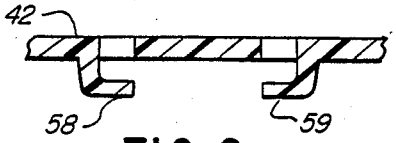
FIG. 9 is a side elevational view, in cross section, taken in the direction of the arrows along the line 9—9 of FIG. 8, showing the manner in which the opposed rails are formed thereby to hold and slidably carry the base support member therebetween.

The further feature illustrated with the embodiments in FIGS. 5 through 9 of the drawings, includes a base support member 56 which is slidably engageable within and between a pair of opposed rail members 58 and 59 respectively. FIG. 7 illustrates the relationship between the rail members 58 and 59, and the food support member 56 supported therein. As shown in FIGS. 5, 6 and 8 of the drawings, the food support member 56 is slidably contained between the rail members 58 and 59, and is designed to slidably move thereby to be movable forwardly where an elongated individualized food product slice is to be supported and held, and moved rearwardly either in the event that the food product slice is smaller in size, or, such as in the case of a pizza pie slice, as the pizza pie slice is eaten by the consumer, the consumer may pull back on the food support member 56 thereby to size the element to the decreasing size of the food slice as it is eaten.

It will further be noted that the outer end 61 of the food support member 56 is shown to include a downturn flange 62 which provides a gripping surface against which the consumer's finger may press in order to facilitate the sliding movement of the food support member 56. The hand positioning of the consumer is generally illustrated in FIG. 5 of the drawings, and shows that the thumb of the hand will be contained on the upper surface of the food gripping flange 50, while the remaining portion of the hand of the consumer is contained on the under side of the device, with the index finger resting against the downturned flange 62. It will be appreicated that as the consumer moves his index finger outwardly, this will withdraw the food support member 56 outwardly, thereby decreasing the overall food support surface available at the forward end of the device.

It will also be observed that the food support member 56 may be designed to contain a plurality of serrations 64 along the edge thereof, which once again will provide a cutting surface for finally cutting the food product slice prior to the consumer's manipulation thereof. It will be appreciated from FIG. 5 of the drawings, that in use, the consumer will grasp the food handling device 40 as illustrated in FIG. 5 of the drawings, slide the food support member 56 under the food product slice to be handled, and then manipulate the food gripping flange 50 downwardly until the food product slice is arrested between the food base support 42, and the food gripping flange 50. In the case of a pizza pie slice, the consumer would simply begin the eating process, and as the slice becomes smaller, may manipulate the food support member 56 outwardly by forcing the index finger against the downturned flange 62. As the piece is substantially eaten, the consumer may simply release the food gripping flange 50 completely, thereby assuming the position shown in FIG. 4 of the drawings, such that access is had to the remainder of the pizze pie slice contained therein.

With respect to FIG. 8 of the drawings, a slightly altered embodiment of the invention is illustrated. In this embodiment, the food gripping flange 50 is shown to be provided with a thumb grasping tab 66 which provides grasping surface for the consumer's thumb in order to enhance the ability to raise and lower the food gripping flange 50 with respect to the base support 42. It is believed that this feature simply makes the reciprocating movement of the food gripping flange 50 relative to the base support 42 more convenient for the consumer in terms of a food gripping and arresting procedure. It will be noted that even with respect to this embodiment, the lower surface of the base support 42 includes the opposed rail members 58 and 59 respectively thereby to support and contain the food support member 56 therein, all in the manner as heretofore indicated.

The embodiment shown in FIGS. 5 through 9 of the drawings is intended to have a pre-set rest position as generally shown in FIG. 4 of the drawings, and a use position as generally shown in FIG. 5 of the drawings, although as indicated above, these positions may be reversed. As such, the device would more likely be packaged within the internal confines of the package in which the food product is ultimately packaged for delivery to the consumer and in most instances, would be designed to fit within one of the corners of the box in which the food product is packaged.

It will further be appreciated that the outer surface of the food gripping flange 50 has sufficient flat area which would provide a legend space 68 similar to the legend space 29 as described with respect to the embodiment shown in FIG. 3 of the drawings. Such space would be intended to be utilized for promotional purposes for the various retail operations which would provide the device for the use of the consumers.

From the foregoing description, it will be apparent that the present invention provides a food handling device which may be formed of a flexible material thereby rendering the device economic in terms of the cost of manufacture, and being the ultimate in simplicity in that the same avoids moving parts while yet permitting the consumer to enjoy the food handling device and avoid direct food contact. In one embodiment of the invention, the device will assume an initial rest position which is planar and flat in configuration, but may be easily manipulated into its use position for handling an individualized food product slice. In the alternate embodiment, the food support member is designed to be slidably reciprocable relative to the base support such that the base support may be made smaller as the food product is being eaten by the consumer. Hence, it will be appreciated that all of the objects and advantages heretofore set forth are achieved by the food handling device of the present invention, while at the same time providing a food handling device which may be manufactured with a minimum of cost thereby to render the same ideal for the mass consumer market.

While there has been described what is at present considered to be the preferred embodiments of the invention, it will be understood that various modifications may be made therein and it is intended to cover in the appended claims all such modifications as fall within the true spirit and scope of the invention.

We claim:

1. A food handling device for handling individual slices of a food product thereby to avoid direct contact with the food product, comprising, base support means forming a food support surface, food gripping means associated with said base support means, flexible means interconnecting said food gripping means with said base support means, said base support means, gripping means, and flexible means being formed integrally, and said elements assuming an initial rest position wherein said elements are planar with respect to one another, said gripping means being movable into a use position substantially overlying and parallel to said base support means thereby to be positioned to arrest a food product between said base support means and said gripping means, said flexible means being relatively resilient such as to permit said food gripping means to be reciprocable toward and away from said base support means to permit said device to have a rest position where said elements are planar with respect to one another and a use position wherein said gripping means is positioned into a use position substantially overlying and parallel to said base support means thereby to be positioned to arrest a food product between said base support means and said gripping means, said base support means, food gripping means, and flexible means being integrally formed thereby to provide a food handling device which is unitary in construction, whereby said food handling device may be adapted to have an initial rest position wherein said base support means, food gripping means, and flexible means are planar with respect to one another, and a use position whereby said food gripping means may be manipulated via said flexible means to ovelie and be parallel to said base support means in order to grasp an individual food product slice therebetween and afford the user the opportunity to handle said food product slice via said food handling device and avoid direct contact with the food product.

2. The food handling device as set forth in claim 1 above, wherein said base support means comprises a base support element being flat in configuration and sized to be insertable under a food product slice.

3. The food handling device as set forth in claim 2 above, wherein said food gripping means comprises a gripping flange connected to said base support element by said flexible means and adapted to be positioned above and reciprocably movable toward said base support element via said flexible means, thereby to grip and arrest a portion of a food product slice therebetween such that the arrested food product slice may be handled and manipulated by the use of said food handling device and avoiding direct use contact with the food product slice.

4. The food handling device as set forth in claim 3 above, wherein said food gripping flange further includes an outer surface forming a user gripping surface, and an inner surface, said inner surface provided with a plurality of food gripping elements formed thereon and extending downwardly therefrom for a short distance, such that the reciprocation of said food gripping flange toward said base support element will force said food gripping elements into gripping contact with a food product slice contained therebetween thereby to facilitate the handling of the food product.

5. The food handling device as set forth in claim 4 above, wherein said gripper elements comprise a plurality of serrations formed integrally along the inner surface of said gripping flange.

6. The food handling device as set forth in claim 3 above, wherein said flexible means comprises a pair of opposed hinge members having an inner end and an outer end, said inner end of each hinge member being interconnected with said base support element, and said outer end of each hinge member being interconnected with said food gripping flange, said hinge elements being sufficiently resilient to permti said gripping flange to be reciprocably removable toward said base support element thereby to grip and arrest a food product slice therebetween.

7. The food handling device as set forth in claim 6 above, wherein said base support element, gripping flange and flexible members are formed integrally and are unitary in construction.

8. The food handling device set forth in claim 3 above, wherein said base further includes an upper food support and a lower surface, said lower surface provided with rail means, a slidable food support member slidably engageable within the confines of said rail means, said slidable food support member adapted to alternately expand and decrease the overall food support surface of said upper food support in relation to the size of the food product slice supported thereon.

9. The food handling device as set forth in claim 8 above, wherein said rail means comprises a pair of opposed rails formed on the lower surface of said base support element and adapted to slidably receive and carry said food support member therebetween.

10. The food handling device as set forth in claim 9 above, wherein said slidable food support member further includes a plurality of cutting serrations formed along the length thereof thereby to provide a cutting edge for cutting food product preliminary to handling the same.

11. The food handling device as set forth in claim 8 above, wherein said food gripping means comprises a food gripping flange positioned substantially above said base support element and interconnected thereto by said hinge means, and the same being reciprocably movable toward said base support element via said hinge means.

12. The food handling device as set forth in claim 3 above, wherein said base support element, gripping flange and flexible means are formed integrally and said elements assuming an initial rest position wherein said elements are planer with respect to one another, said gripping flange being movable into a use position substantially overlying and parallel to said base support element thereby to be positioned to arrest a food product slice between said base support element and said gripping flange.

13. The food handling device as set forth in claim 12 above, wherein said hinge means comprises a pair of opposed hinge members innerconnected between said base support element and said gripping flange, said hinge members formed of a resilient material thereby to flex between a rest position and a use position.

14. A food handling device as set forth in claim 13 above, wherein said hinge members each includes at least one score line extending thereacross thereby to facilitate the hinge motion of said hinge member in moving said gripping flange between the rest position and the use position thereof.

15. The food handling device as set forth in claim 12 above, wherein said gripping flange includes an outer gripping surface and an inner surface, said inner surface provided with a plurality of food gripping elements formed thereon and extending outwardly therefrom such that when said gripping element is moved into its use position via said hinge members, said food gripping elements are positioned for gripping engagement with a food product positioned and arrested between said base support element and said gripping flange.

16. The food handling device as set forth in claim 12 above, wherein said base support element includes a forward end, said forward end provided with a plurality of serrations formed thereon and adapted to render said forward end as a cutting edge to permit cutting the food product slice preliminary to handling and arresting said cut food product slice.

* * * * *